US005230268A

United States Patent [19]

Richter

[11] Patent Number: 5,230,268

[45] Date of Patent: Jul. 27, 1993

[54] DEVICE FOR CROSS CUTTING AND/OR PERFORATING OF A WEB

[75] Inventor: Johannes Richter, Augsburg, Fed. Rep. of Germany

[73] Assignee: Man Roland Druckmaschinen AG, Offenbach am Main, Fed. Rep. of Germany

[21] Appl. No.: 896,335

[22] Filed: Jun. 10, 1992

[30] Foreign Application Priority Data

Jun. 22, 1991 [DE] Fed. Rep. of Germany ..... 4120628

[51] Int. Cl.[5] ..... B26D 1/62

[52] U.S. Cl. ..... 83/303; 83/155; 83/332; 83/404

[58] Field of Search ..... 83/49, 41, 42, 43, 332, 83/333, 404, 404.4, 303, 155, 151, 343, 341, 346, 347, 300; 493/361, 365, 369, 370

[56] References Cited

U.S. PATENT DOCUMENTS

| | | | |
|---|---|---|---|
| 4,442,742 | 4/1984 | Orlow | 83/303 |
| 4,613,321 | 9/1986 | Kesten et al. | 83/303 X |
| 4,983,155 | 1/1991 | Stobb | 83/155 X |
| 5,103,703 | 4/1992 | Littleton | 83/404 X |

FOREIGN PATENT DOCUMENTS

| | | |
|---|---|---|
| 2811109 | 9/1978 | Fed. Rep. of Germany . |
| 2846191 | 4/1980 | Fed. Rep. of Germany . |
| 3900663 | 7/1989 | Fed. Rep. of Germany . |

*Primary Examiner*—Frank T. Yost
*Assistant Examiner*—Rinaldi Rada
*Attorney, Agent, or Firm*—Frishauf, Holtz, Goodman & Woodward

[57] ABSTRACT

Apparatus for cross cutting and/or perforating of a web. The apparatus performs two consecutive partial cuts and, provides for positive guidance of a partially cut web. This is accomplished by first and second cutting blade rollers, arranged with one common counter cylinder and guided by groups of belts passing through breaks in the blades. The breaks of the two blades are laterally offset relative to each other, and the belts are pressed against the counter cylinder to convey the web. This eliminates the need for one counter cylinder and one pair of pull rollers, it decreases the danger of web tear and eliminates the web stretching and the accompanying offset of the two partial cuts.

6 Claims, 1 Drawing Sheet

DEVICE FOR CROSS CUTTING AND/OR PERFORATING OF A WEB

Reference to related application, the content of which is hereby incorporated by reference.

This application is related to U.S. Ser. No. 07/896,336, filed Jun. 10, 1992, titled "Device for Cross Cutting a Web" filed concurrently herewith (claiming priority of German Appln. No. P 41 20 629.0, filed Jun. 22, 1991).

FIELD OF THE INVENTION

This invention relates to an apparatus for cross cutting a web used, for instance, in rotary printing presses and, in particular, to an improved arrangement for guiding the web after it has been partially cut.

BACKGROUND

The German Patent Disclosure Document 39 00 663 shows a cross cutting device as part of a folding machine where a web is partially cut by a first cutting device containing a cutting blade roller and a counter cylinder. The cutting blade is formed with breaks so that it leaves uncut sections in the cutting line. Pairs of pull rollers are provided on both sides of the cutting device. The partially cut web is then guided over a folding cylinder where it is cut completely while being partially wrapped around the cylinder and while being guided by belts. For this purpose, the folding cylinder, containing counter blade strips, is arranged with a cutting blade roller that also is equipped with a cutting blade which has breaks in it. These breaks are laterally offset from the breaks in the blade of the first cutting device so that the partially cut web is completely cut. The belts used for guiding the partially cut web are guided through the breaks in the blades. It is also possible to equip both cutting blade rollers with perforating blades having the same kind of breaks and to use the device for cross perforating.

The disadvantage of this system is that the partially cut web is not positively guided until it enters the area between the folding cylinder and the belts. This can cause web stretching that may lead to an offset of the two partial cuts causing the cut not to be straight and clean. Because the web stretching varies, the lengthwise offset of the cuts needs constant readjustment and, therefore, cannot be practically eliminated. Furthermore, the web can tear as a result of the partially cut web having no positive guidance. Also, a non-guided multilayer partially cut web folded lengthwise by a folding triangle, may form a bubble. Finally, the cross cutting devices, each containing two cutting blade rollers and counter cylinders as well as two pairs of pull rollers, are expensive to produce.

THE INVENTION

The main purpose of the invention is to design a device for cross cutting and/or perforating of a web which provides reliable positive guidance for the partially cut web without requiring a complex structural arrangement.

Briefly, first and second cutting blade rollers provided with cutting or perforating blades having breaks in the cutting edge. The breaks of one blade are laterally offset relative to the breaks in the other blade. Each blade produces a partial cut so that a complete cut or perforation is obtained when the web has passed both blades. A first group of moving belts is provided to guide the web, and the belts are guided through the breaks of the blade in the first cutting blade roller and are arranged to press the web against a counter cylinder. A second group of moving belts is provided to guide the web, these belts being guided through the breaks in the blade of the second cutting blade roller and arranged to press the web against the counter cylinder.

Because of the arrangement of both cutting blade rollers with the counter cylinder, the necessity for another such roller is eliminated. Furthermore, one pair of pull rollers is no longer necessary. The device is therefore less costly to produce. Additionally, both partial cuts and the transport of the partially cut web take place with the partially cut web pressed by the belts against the counter cylinder, thereby eliminating web stretching between the two cutting places and thus avoiding an offset between the two cuts. Finally guidance of the web is further improved by being pressed against the belts in the area of the two cutting places. A continuous positive guidance of the partially cut web on the counter cylinder is achieved when, according to the invention, both groups of belts overlap in being pressed against the counter cylinder. The number of rollers guiding the belts can be minimized when, according to the invention, both groups of belts wrap around a common belt roller, placed at the counter cylinder between the first and the second cutting blade rollers.

DRAWINGS

FIG. 1 shows a schematic cross section of an apparatus for cross cutting a web; and FIG. 2 shows a view taken in the direction of arrow Z of the apparatus of FIG. 1.

DETAILED DESCRIPTION

Figure 1:
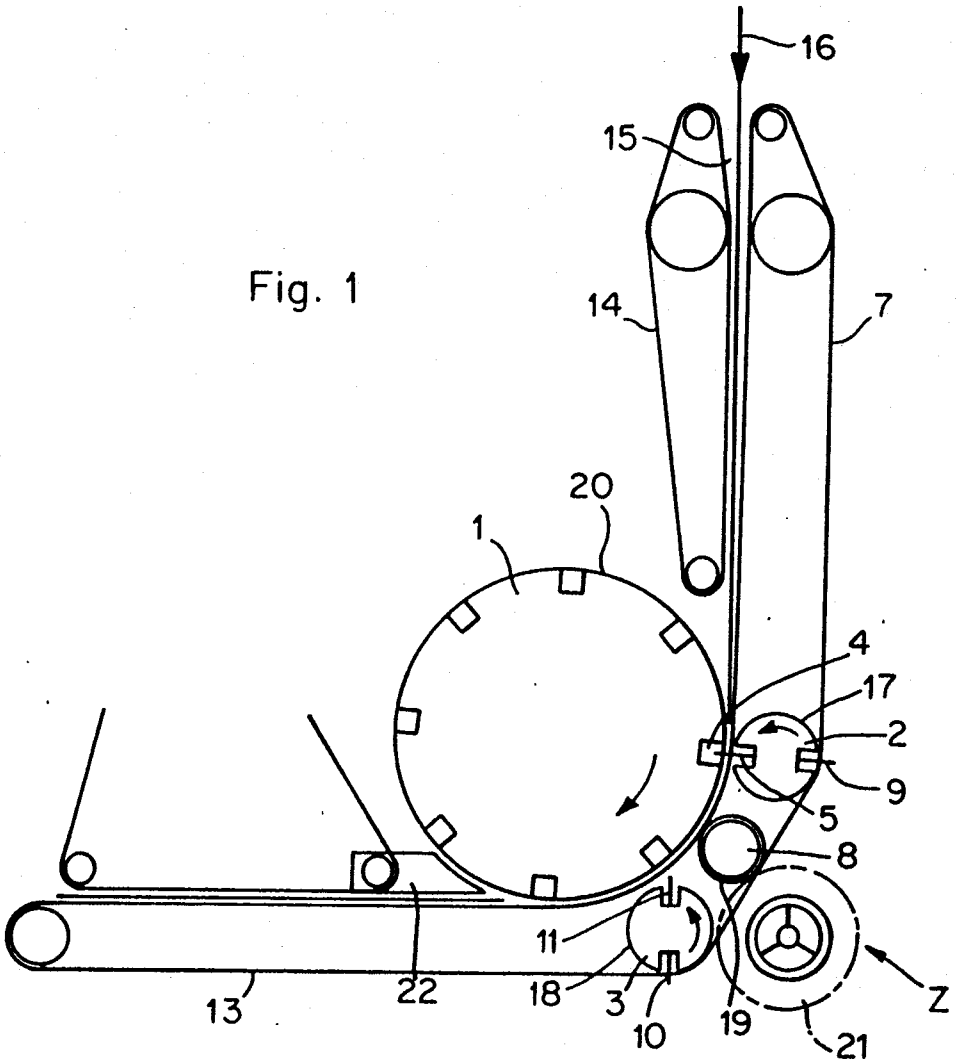
Figure 2:
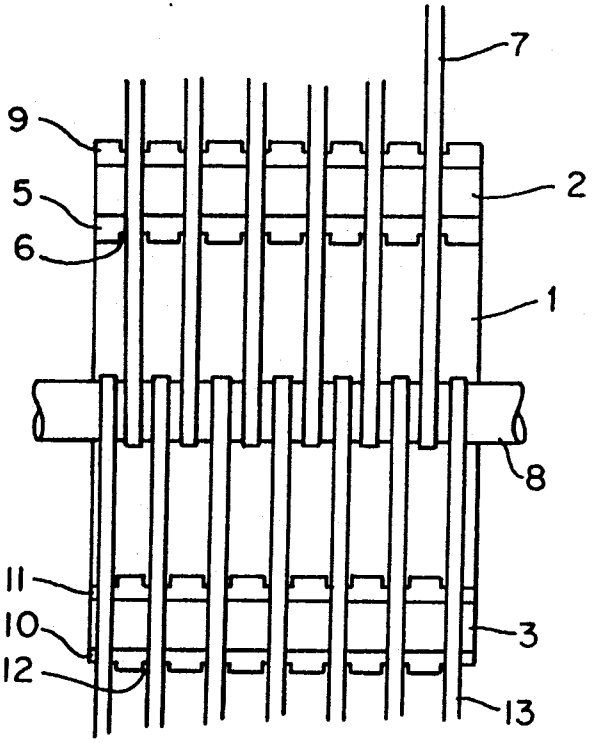

The cross cutting apparatus shown in FIG. 1 includes a counter cylinder 1 arranged in cooperative association with first and second cutting blade rollers 2 and 3. The counter cylinder 1 is equipped with counter blade strips 4. The distance along the circumference of counter cylinder 1 between adjacent strips 4 is equal to half of the desired length of the cut sheets. The first cutting blade roller 2 has a circumference equal to the desired length of the cut sheets and is equipped with a cutting blade 5. The edge of the cutting blade 5 is formed with breaks 6 (FIG. 2). A group of moving belts 7, which press against the counter cylinder 1, passes the blade area through these breaks 6. Belts 7 are guided by a belt roller 8 placed at the counter cylinder 1 between the cutting blade rollers 2 and 3. Opposite the cutting blade 5, the cutting blade roller 2 is equipped with a perforating blade 9 with breaks formed in the same locations as the cutting blade 5. The second cutting blade roller 3 is similarly equipped with a cutting blade 10 and a perforating blade 11, both being formed with breaks 12 such as the above-described breaks. Breaks 6 and 12 in cutting blades 5 and 10 are laterally offset from each, as shown in FIG. 2. Likewise, the breaks in perforating blades 9 and 11 are laterally offset from each other. Another group of moving belts 13, which press against the counter cylinder 1, passes the blade area through these breaks. These belts 13 are also guided by the belt roller 8. Another group of moving belts 14 is located above the counter cylinder 1 and with belts 7 forms a guiding channel 15 for the web 16 which is to be cut.

The first and the second cutting blade rollers 2 and 3, and belt roller 8, are equipped with gear wheels 17, 18 and 19, respectively. Gear wheels 17 and 19 are engaged with gear wheel 20 of counter cylinder 1. Gear wheel 19 drives gear wheel 18 via gear wheel 21. Gear wheel 21 is shaped as a dual gear wheel with left/right gearing allowing an adjustment of cutting blade rollers 2 and 3 when it is moved, bringing both partial cuts into registration with each other. Since this is not part of the invention, and is also well known, it is not further explained herein.

OPERATION

The web 16 to be cut is, for instance, an imprinted web folded lengthwise with a folding triangle. Web 16 runs into the guiding channel 15 and then into the entrance slit formed by the group of moving belts 7 and the counter cylinder 1. Web 16 is first cut partially by the cutting blade 5 in cooperation with the counter blade strip 4. Breaks 6 leave uncut areas in the cutting line of the web 16. These uncut areas are cut with the cutting blade 10 of the second cutting blade roller 3 in cooperation with a counter blade strip 4. The perforating blades 9 and 11 perform a perforating cut in two steps, in cooperation with the counter blade strips 4, in a manner similar to that described above with respect to cutting blades 5 and 10.

Web 16 touches the counter cylinder 1 at or prior to reaching the cutting position of cutting blade roller 2, and from there until after it is cut by cutting blade roller 3, web 16 is constantly pressed against counter cylinder 1 by belts 7 and 13. Stretching of web 16 is prevented by virtue of the positive guidance exerted on it with such an arrangement from the first partial cut by blade 5 until after the second partial cut by blade 10.

The cut sheets are transported by belts 13 and other handling devices, and a stripper 22 ensures proper take off from the counter cylinder 1.

In the preferred embodiment disclosed above, the cutting blade rollers 2 and 3 are equipped with cutting and perforating blades. The perforation is done in preparation of a later cross folding. However, the perforating blades may be eliminated. Furthermore, the apparatus may also be equipped with perforating blades only, and the apparatus used only for cross perforating. These and other such modifications which are readily apparent to one of ordinary skill in the art are intended to fall within the scope of the present invention as defined by the following claims.

I claim:

1. An apparatus for cross cutting of a web, comprising:

first and second cutting blade rollers (2,3) each having a cutting blade (5,10) with breaks (6,12) formed in an edge of the cutting blade, the breaks in the cutting blade edge of said first cutting blade roller being laterally offset with respect to breaks in an edge of the cutting blade of said second cutting blade roller to enable a complete lateral cut of the web as a result of partial cuts made by both of said first and second cutting blade rollers (2,3);

a counter cylinder positioned adjacent said first and second cutting blade rollers for cooperating therewith in cutting the web;

a first group of moving belts (7) guided through the breaks (6) of the cutting blade (5) in the first cutting blade roller (2) and arranged to press the web (16) against said counter cylinder (1) to guide the web (16); and a second group of moving belts (13) guided through the breaks (12) in the cutting blade (10) of the second cutting blade roller (3) and arranged to press the web (16) against said counter cylinder (1) to guide the web (16).

2. The apparatus according to claim 1, wherein portions of the first and second groups of belts are pressed against said counter cylinder.

3. The apparatus according to claim 1, further comprising a common belt roller located at the counter cylinder between the first and the second cutting blade rollers, and wherein portions of the first and second group of belts respectively wrap around said common belt roller.

4. An apparatus for perforating a web, comprising:

first and second cutting blade rollers (2,3) each having a perforating blade (9,11) with breaks (6,12) formed in an edge of the cutting blade, the breaks in the perforating blade edge of said first cutting blade roller being laterally offset with respect to breaks in an edge of the perforating blade of said second cutting blade roller to enable a complete perforation of the web as a result of partial perforations made by both of said first and second cutting blade rollers (2,3);

a counter cylinder positioned adjacent said first and second cutting blade rollers for cooperating therewith in cutting the web;

a first group of moving belts (7), guided through the breaks (6) of the perforating blade (9) in the first cutting blade roller (2) and arranged to press the web (16) against said counter cylinder (1) to guide the web (16); and a second group of moving belts (13) guided through the breaks (12) in the perforating blade (11) of the second cutting blade roller (3) and arranged to press the web (16) against said counter cylinder (1) to guide the web (16).

5. The apparatus according to claim 4, wherein portions of the first and second groups of belts are pressed against the counter cylinder in an overlapping fashion.

6. The apparatus according to claim 4, further comprising a common belt roller located at the counter cylinder between the first and the second perforating blade rollers, and wherein portions of the first and second groups of belts respectively wrap around said common belt roller.

* * * * *